US005375380A

United States Patent [19]

Jones

[11] Patent Number: 5,375,380

[45] Date of Patent: Dec. 27, 1994

[54] BUILDING EXTENSION

[76] Inventor: Ian Jones, 2 Cobbett Pl., Bruce Act 2617, Australia

[21] Appl. No.: 103,109

[22] Filed: Aug. 9, 1993

[30] Foreign Application Priority Data

Aug. 14, 1992 [AU] Australia ..... PL4132

[51] Int. Cl.[5] ..... E04H 1/00

[52] U.S. Cl. ..... 52/34; 52/79.1

[58] Field of Search ..... 52/34, 35, 79.1

[56] References Cited

U.S. PATENT DOCUMENTS

| | | | |
|---|---|---|---|
| 877,196 | 1/1908 | Hubert | 52/34 X |
| 1,854,443 | 4/1932 | Bard | 52/35 X |
| 2,644,203 | 7/1953 | Donahue | 52/34 |
| 2,650,368 | 9/1953 | Evans | 52/34 |
| 3,047,106 | 7/1962 | Callahan | 52/34 |
| 3,110,907 | 11/1963 | King | 52/34 |
| 3,162,863 | 12/1964 | Wokas | 52/34 X |
| 3,727,753 | 4/1973 | Stan | 52/34 X |
| 4,788,802 | 12/1988 | Wokas | 52/34 X |
| 4,862,527 | 9/1989 | McAllister | 52/34 X |

*Primary Examiner*—Carl D. Friedman
*Assistant Examiner*—Beth A. Aubrey
*Attorney, Agent, or Firm*—Michael D. Bednarek

[57] ABSTRACT

A building extension including a preformed shell-/module in the shape of the desired extension and which is connectable to an external wall having an external surface which harmonizes or aesthetically contrasts with the existing design of the building. The external wall may be in the shape of a bay window and the shell/module may be located at least partially within the bay of the bay window.

7 Claims, 3 Drawing Sheets

BUILDING EXTENSION

TECHNICAL FIELD

This invention relates primarily to building extensions. However the "extension" of the invention could be incorporated in a new home.

The invention has particular but not exclusive application to adding ensuite or bathroom facilities to an existing dwelling and particular reference will be made hereinafter to such application. However, the invention is also applicable to other building extensions such as increasing the size of a room or the addition of a laundry, toilet, shower or study to a dwelling.

BACKGROUND OF THE INVENTION

Conventional methods of building extensions involve relatively time consuming, expensive, and disruptive tradework. Also, to avoid expense, the extension is often simply "tacked on" to an existing wall of the building and this can tend to spoil the overall appearance of the original building design.

The present invention aims to alleviate at least one of the above disadvantages and provide a building extension which is relatively inexpensive, simple to install and/or which will be a useful alternative to known extensions.

SUMMARY OF INVENTION

With the foregoing in view, this invention in one aspect resides broadly in a pre-fabricated building extension including:

shell/module means; and external wall means connectable to said shell/module means.

The building extension and/or shell may include floor and/or ceiling means and is normally pre-fabricated off-site and may be formed of any suitable material such as plastics, acrylics or glass fiber. However the extension may be conveniently fabricated in several components which are adapted to be assembled/bonded together on-site. Alternatively, the components of the extension may be formed integrally in one piece or more pieces, for example by moulding from composite plastics material.

The shell/module means could be shaped to suit many different types of building or room extensions such as increasing a room size or by adding a study, laundry, spa, toilet bath or shower. In a preferred arrangement the shell is in the form of a bathroom/ensuite.

The shell/module means may include sub-division walls, doors and/or doorways and various types of fittings. For example, in the case of an ensuite extension the shell could include a dividing wall to separate the toilet/shower module from the basin area. It could also include a sliding or swing door plus shower, toilet and washbasin fittings. It could also include a spa or a spa/bath/shower combination and it should be understood that the invention is not limited to any particular floor plan or configuration.

The external wall of the extension may be formed integral with, or may be suitably attached to, the shell. A space, adapted to receive view blocking means such as a curtain, screen or the like (as described hereinafter) may be provided between the external wall and the shell. The external wall may be provided with a wing or wings which extend beyond one or both sides of the shell and which are adapted to be suitably connected to a component, such as a wall, of the existing building. In one arrangement the external wall of the extension is in the form of a bay window with the shell being positioned at least partially within the bay of the bay window, and with the two wings of the bay extending either side of the shell. The wings can be arranged in any configuration, for example the bay window may include a wing on one or both sides of the shell.

The external wall window may be formed of any suitable material and in any size or shape, but is preferably designed to harmonise or aesthetically contrast with the existing design of the building. The wall may be provided with a window which preferably blends with the design of any existing window of the building. The external wall portion surrounding or alongside the window may be provided with any suitable surface treatment such as glass, timber panelling, brick facing or cement sheeting to harmonise or provide an aesthetically pleasing contrast feature with the existing building design. At least a portion of the window may be "false", reflective or frost treated so that the shell is not visible from outside the building. Alternatively, the window portion may be formed of clear glass and view blocking means such as an aesthetic screen, curtain or the like could be located in a space provided between the glass and the rear wall of the shell to prevent the shell being visible from outside the building.

The shell and/or external wall may be fabricated utilising stiffeners or strengtheners, such as wooden battens, and the stiffeners may also act as connection means for connecting the shell to the external wall or to other components of the building. The stiffeners may be oriented in any convenient direction and may also create spaces within which to locate extension fittings such as electrical wiring and plumbing pipes. The stiffeners may be formed separately or integrally with the shell. Alternatively, stiffening may be provided by a layer of stiffening material over the major surfaces of the extension.

According to another aspect this invention resides broadly in a pre-formed building extension including:

shell/module means; and connection means on the shell for connecting the shell to external wall means.

According to yet another aspect this invention resides broadly in a method of installing a pre-formed extension of the type described herein, the method including:

preparing external utility supplies such as water, drainage and electricity for the extension;

providing a suitable opening in the wall of the existing building;

locating the pre-formed building extension in position within the opening and suitably attaching the extension to the building; and connecting the external utilities to the shell/module internal fittings.

DESCRIPTION OF DRAWINGS

In order that the present invention may be more easily understood and put into practical effect, reference will now be made to the accompanying drawings which illustrate preferred embodiments of the invention, wherein.

DETAILED DESCRIPTION OF PREFERRED EMBODIMENT

Figure 1:
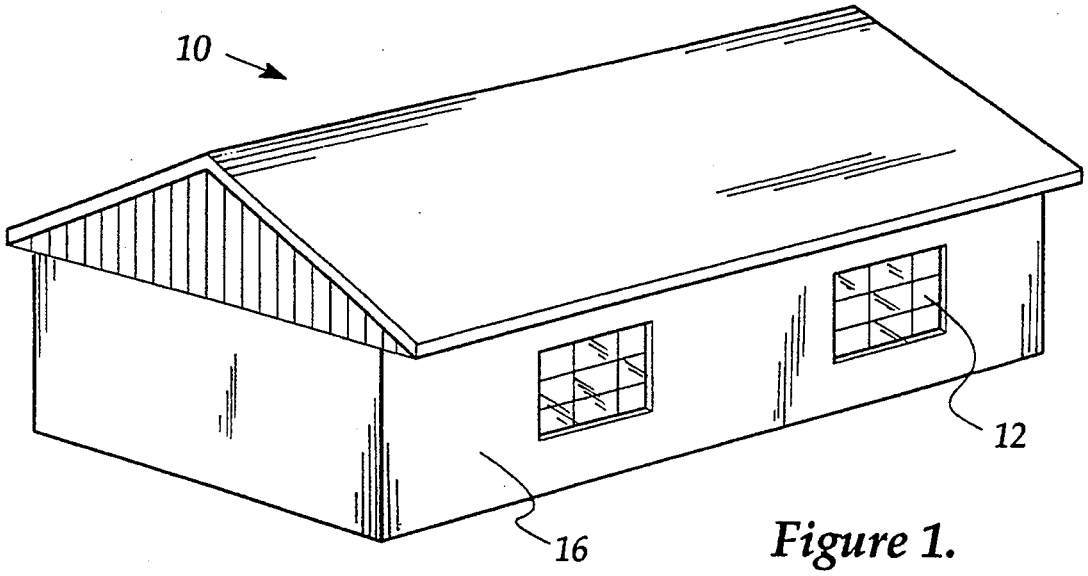
FIG. 1 is a perspective view of a house prior to installation of a pre-formed extension in accordance with this invention.
Figure 2:
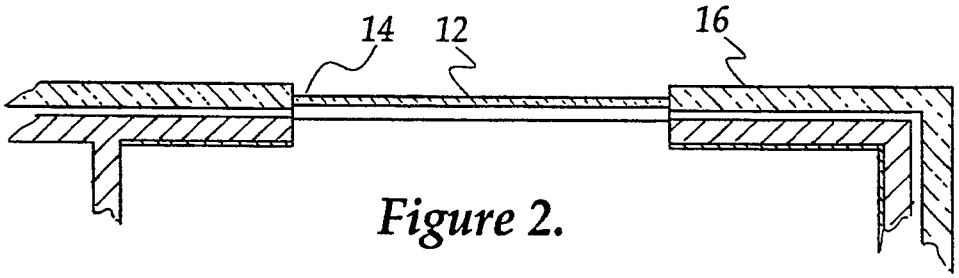
FIG. 2 is a part sectional plan view of the window wall of the house shown in FIG. 1.

The house 10 (prior to installation of a preformed extension) illustrated in FIGS. 1 and 2 includes windows 12 received in openings 14 provided in side walls 16.

Figure 3:
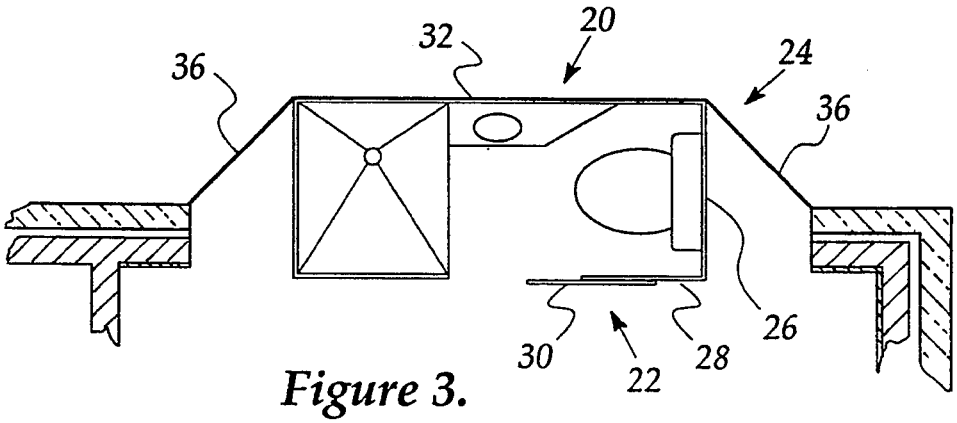
FIG. 3 is a part sectional plan view of the house of FIGS. 1 and 2 subsequent to installation of a prefabricated ensuite extension in accordance with this invention.
Figure 4:
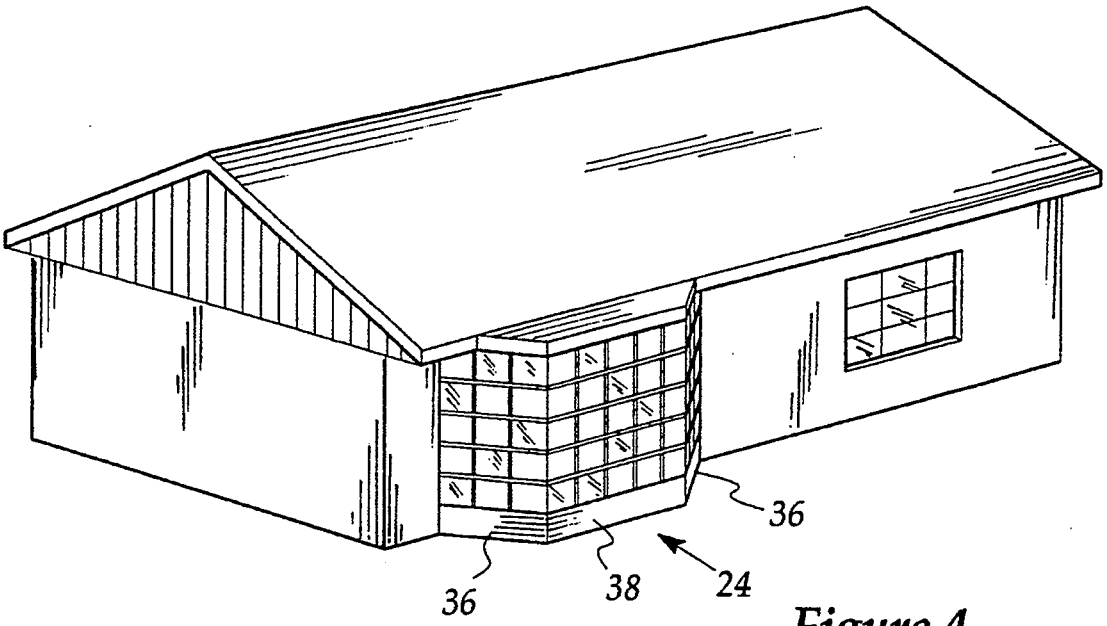
FIG. 4 is a perspective external view of the house shown in FIG. 3.
Figure 5:
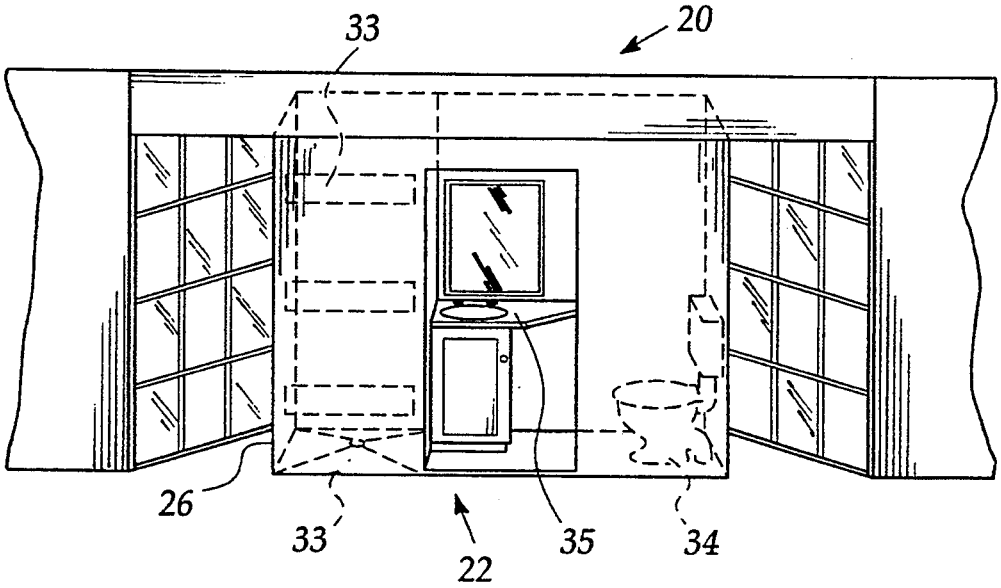
FIG. 5 is a perspective internal part view of the house shown in FIGS. 3 and 4.

To install a pre-formed ensuite extension the opening 14 is enlarged (or formed if no existing window is sited on the wall) as can be seen from FIG. 3 to receive a pre-fabricated extension 20. The extension 20 illustrated in FIGS. 3 to 5 is formed from plastics fiber material and includes an ensuite shell/module 22 suitably attached or spaced from an extension external wall 24. The shell 22 includes side walls 26, inside wall 28 (including a sliding door 30), rear wall 32 and a ceiling (not shown) containing a skylight. The shell, or portions of the shell, may be fabricated using stiffening means in the form of a layer of stiffening material or wooden battens 31 (see FIG. 5 where, for convenience, only the shell front wall battens are illustrated) which can also be utilised as connection means for connecting the shell to the external wall 24 or to other wall panels and building components. The space between the battens can be utilised to receive any electrical wires and plumbing pipes. As best seen in FIG. 5 the shell 22 also includes a shower 33, toilet 34, washbasin 35 and other usual bathroom accessories.

The extension external wall 24 is in the form of a bay window having two wing portions 36 provided with windows which extend either side of the shell 22, and a central "false" portion 38. The central false portion is designed to obscure the rear wall 32 (shown in FIG. 3) of the ensuite shell 20 so that wall 32 is not visible from outside the house, and the shell 20 is located partially within the bay of the bay window. The external surface of the false portion 38 is treated so as to match or aesthetically contrast with the appearance of the two wing portions of the bay window. Alternatively, the central portion 38 may be formed of clear glass and a suitably patterned screen 39 (FIG. 5) could be located between the glass and the rear wall 32 of the shell 20 to create a similar appearance.

Figure 6:
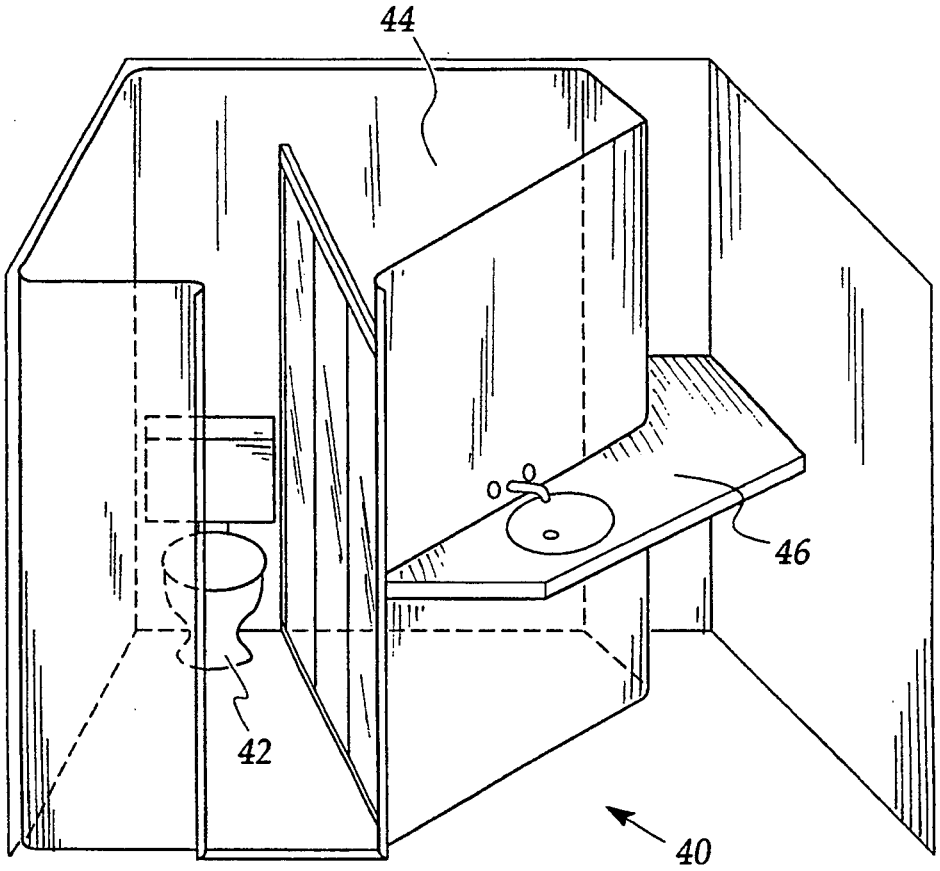
FIG. 6 is a perspective view of an alternative ensuite shell/module layout.
Figure 7:
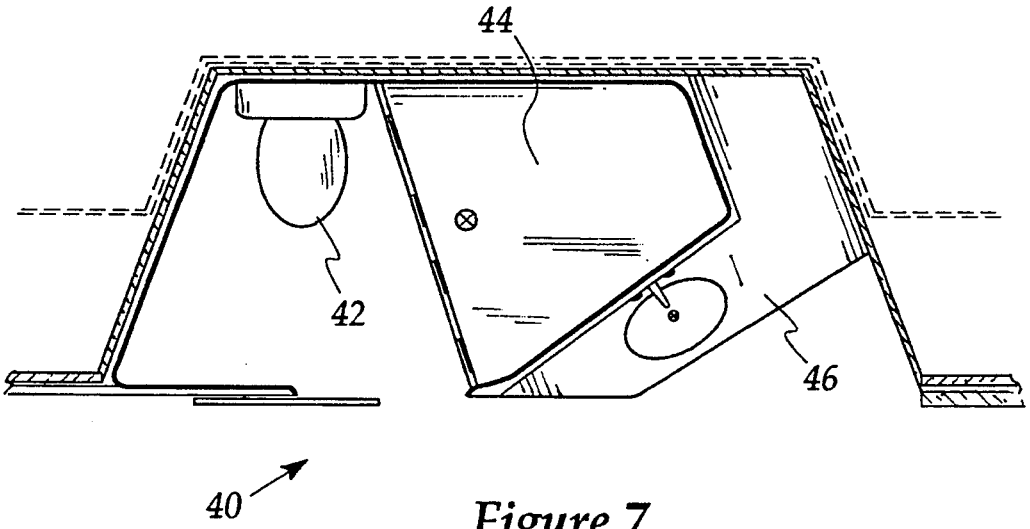
FIG. 7 is a part sectional plan view of the shell of FIG. 6 when installed.

The embodiment of FIGS. 6 and 7 utilises a different ensuite module floor plan to that of FIGS. 3 and 5. The module 40 includes a toilet 42, a shower recess 44 and a vanity basin and bench 46.

The bay pre-formed window ensuite extension of the embodiments can be installed and commissioned more easily and more quickly than conventional extensions known to the applicant, thus providing savings in time consuming and expensive tradework and reducing relatively long periods of messy and internal disruption.

Also the embodiments have advantages in providing additional bathroom/ensuite facilities to a home which was not originally designed to accommodate such facilities, and where an existing room is too small to be redesigned say, to accommodate an ensuite. The conventional method of extending in such situations is to "tack" onto an existing wall a relatively expensive extension in the form of an additional room, which often protrudes externally from the house wall and spoils the overall external appearance of the house. However, it is possible with, for example, the bay window ensuite of the embodiments, to provide additional space utilising existing wall thickness and eaves overhang space, whilst providing additional bathroom or other facilities. Locating the shell at least partially within the bay of the bay window is space saving and internally aesthetic. Also the external facade of the bay window component provides an attractive external feature which, in contrast to a "tacked on" conventional extension, enhances the external appearance of the home.

Thus the embodiments result in an aesthetically pleasing bay window facade. It provides internal space for the ensuite/bathroom module and the facade obscures the module from external view. It also provides these facilities to a building where small existing room size would normally preclude them.

It will of course be realised that whilst the above has been given by way of illustrative examples of the invention, all such and other modifications and variations thereto, as would be apparent to persons skilled in the art, are deemed to fall within the broad scope and ambit of the invention as is defined in the appended claims.

I claim:

1. A building extension for a building, said building extension including:

a preformed module having bathroom and toilet fittings and constituting an en suite/bathroom facility, said module having an exterior surface;

external wall means connectable to a wall of said building and to said module, wherein said external wall means is a bay window and said module is located at least partially within said bay window; and screening means located between the exterior surface of said module and the interior surface of said bay window, said screening means substantially preventing the exterior surface of said module being seen from outside the building and thereby creating an illusion when the building extension is viewed from outside that the building extension is a bay window and not an en suite/bathroom facility.

2. A preformed building extension for a building as claimed in claim 1, wherein said screening means constitutes a false window.

3. A preformed building extension for a building as claimed in claim 2, wherein said module is formed of plastics material and is provided with a floor, walls and ceiling.

4. A preformed building extension for a building as claimed in claim 3, wherein the exterior surface of said module is provided with stiffeners and wherein spaces are created between the stiffeners within which to locate extension fittings, such as water and electricity fittings.

5. A preformed building extension for a building as claimed in claim 3, wherein the external wall is provided with stiffeners and wherein spaces are created between the stiffeners within which to locate extension fittings, such as water and electricity fittings.

6. A building extension for a building, said building extension including:

a preformed bathroom module, said bathroom module having an exterior surface;

external wall means connectable to a wall of said building and to said module, wherein said external wall means is a bay window that includes a plurality of translucent panes and said module is located at least partially within said bay window; and screening means located between the exterior surface of said module and the translucent panes of said bay window, said screening means substantially preventing the exterior surface of said module being seen from outside.

7. A building extension for a building, said building extension including:

a preformed bathroom module having bathroom and toilet fittings, said bathroom module having an exterior surface;

external wall means connectable to a wall of said building and to said module, wherein said external wall means is a bay windowshaving a plurality of translucent panes arranged to form an enclosure and said module is located at least partially within said enclosure formed by the panes of the bay window; and screening means located between the exterior surface of said bathroom module and the translucent panes of said bay window, said screening means substantially preventing the exterior surface of said bathroom module being seen from outside.

* * * * *